United States Patent [19]

Larsen et al.

[11] Patent Number: 4,733,622

[45] Date of Patent: Mar. 29, 1988

[54] THREAD END HOLDER FOR SEWING MACHINE WITH THREAD WINDING BOBBIN

[75] Inventors: Robert H. Larsen, Middletown; Jan Szostak, Lincroft, both of N.J.

[73] Assignee: SSMC Inc., Shelton, Conn.

[21] Appl. No.: 17,951

[22] Filed: Feb. 24, 1987

[51] Int. Cl.[4] ..... D05B 29/12; D05B 59/00; D05B 63/00

[52] U.S. Cl. ..... 112/240; 112/253; 112/279; 242/125.2

[58] Field of Search ..... 112/181, 184, 240, 253, 112/279; 242/125.2, 164, 165

[56] References Cited

U.S. PATENT DOCUMENTS

| | | | |
|---|---|---|---|
| 299,739 | 6/1884 | Clark | 242/125.2 |
| 3,096,736 | 7/1963 | Johnson | 112/253 X |
| 3,115,110 | 12/1963 | Ketterer | 112/181 |
| 3,457,889 | 7/1969 | Killinger et al. | 112/240 |

FOREIGN PATENT DOCUMENTS

| | | | |
|---|---|---|---|
| 418406 | 10/1934 | United Kingdom | 242/125.2 |

*Primary Examiner*—Wm. Carter Reynolds
*Attorney, Agent, or Firm*—Robert E. Smith

[57] ABSTRACT

A needle thread end holder for a sewing machine having bobbin thread replenishing mechanism in which an annular groove formed in the presser securing screw accomodates a stretched rubber "O" ring so as to apply only a limited frictional resistance to a thread introduced beneath the "O" ring insufficient to abort a bobbin thread replenishing operation.

4 Claims, 5 Drawing Figures

Fig. 1.
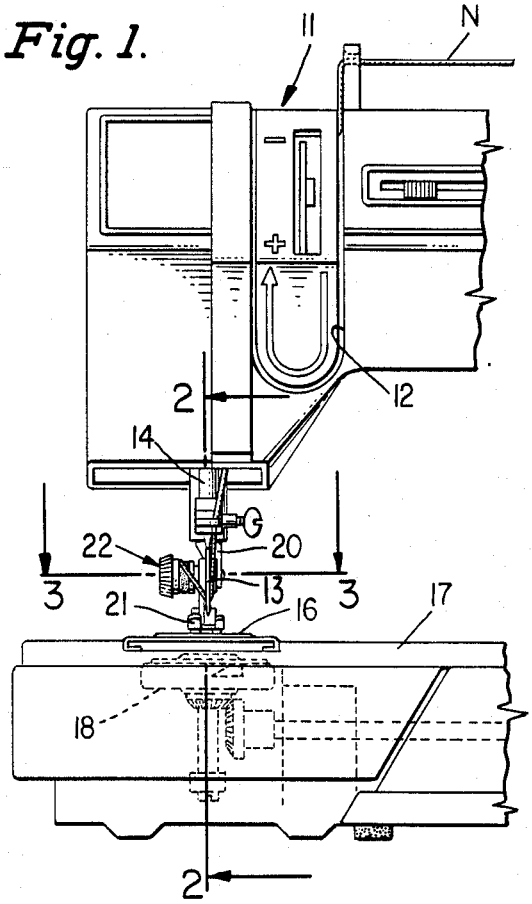
Fig. 3.
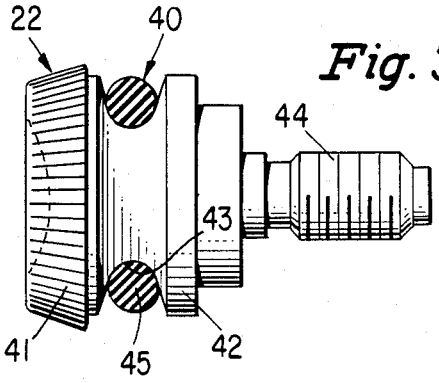
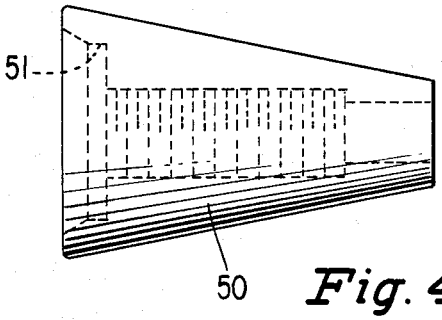
Fig. 4.
Fig. 5.
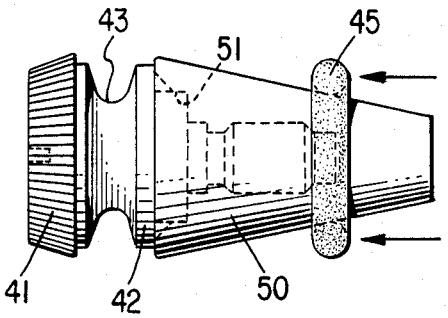
Fig. 2.
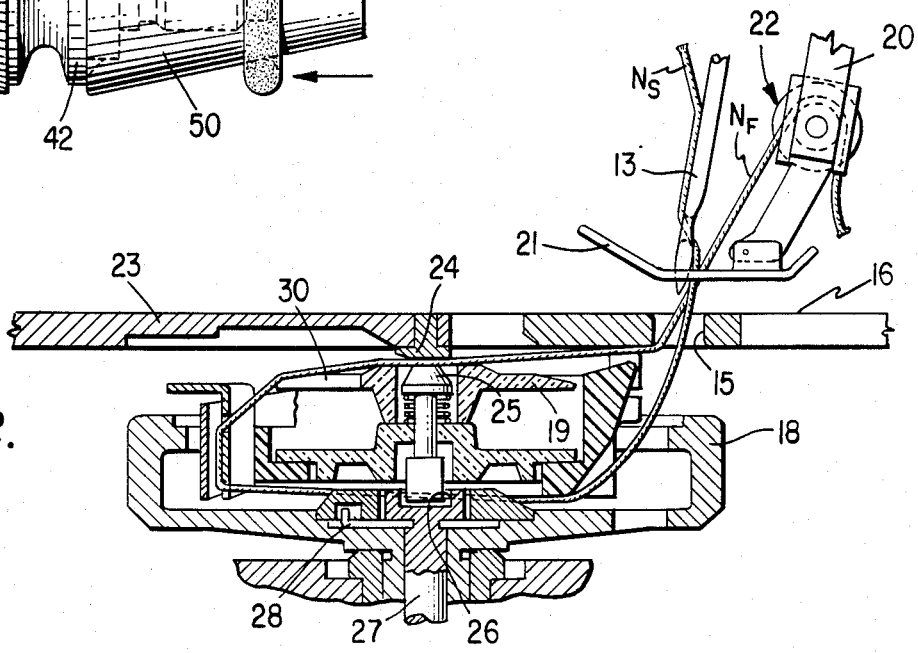

THREAD END HOLDER FOR SEWING MACHINE WITH THREAD WINDING BOBBIN

FIELD OF THE INVENTION

This invention relates to a thread end holding or nipping device, and more particularly, to a thread end holder for the needle thread end of a lock stitch sewing machine having a mechanism for replenishing thread on the bobbin in place in the loop taker.

DESCRIPTION OF THE PRIOR ART

The sewing machine art includes numerous disclosures of metallic spring devices such as that of U.S. Pat. No. 3115110, Dec. 24, 1963, of S. J. Ketterer, which apply a relatively high restraining force on a thread introduced thereto. Not only are such metallic spring thread end holders expensive because of the critical tolerances required in their manufacture, tempering and assembly, but to provide for any limitation on the restraining force applied to the thread by such metallic spring devices would involve even higher and prohibitive costs.

BACKGROUND OF THE INVENTION

In the prior art of devices for replenishing thread on a bobbin in place in a sewing machine loop taker, various means have been taught for positively retaining or anchoring the needle thread end at the initiation of bobbin winding, such as that disclosed in U.S. Pat. No. 3,099,972, Aug. 6, 1963, of Johnson et al. Applicants are unaware of any disclosure or teaching in the prior art of controlled release or pay-out of the nipped needle thread end to facilitate thread introduction to the bobbin and uninterrupted initiation of bobbin thread replenishment.

Modern mechanisms for replenishing thread on a bobbin while the bobbin remains in place in the sewing machine loop taker include a friction clutch device in the drive train for rotating the bobbin during the bobbin thread replenishing process, such as the clutch device 132 disclosed in U.S. Pat. No. 4,515,099, May 7, 1985, of Gerald J. Creed, which is incorporated herein by reference. The function of the spring clutch in the drive for the bobbin during thread replenishment is to release the drive in case excessive resistance to turning of the bobbin is encountered, as for instance, if overwinding of the bobbin is inadvertently attempted, so as to prevent damage to the delicate and critical parts of the sewing machine loop taker.

It has been found that where the needle thread end is positively anchored during initiation of bobbin thread replenishment, the static friction acting upon the supply limb of needle thread, even though the needle thread tension device is released can at times be sufficient to exceed that which is necessary to override the friction clutch device in the drive train for rotating the bobbin. Where this occurs, an annoying interruption of bobbin thread replenishment results.

SUMMARY OF THE INVENTION

It is an object of this invention to provide a unique solution to the problem of preventing such interruption of the bobbin thread winding by the provision of a thread holding device for the tag end of needle thread which rather than positively anchoring the thread end to the sewing machine frame, instead merely grips the thread with a frictional force limited to a value which is less than that necessary to overcome the friction clutch device in the drive train for rotating the bobbin. It is an object of this invention, moreover, to provide a thread end holder of the above description which is particularly cost effective since it does not require adherence to high dimensional tolerances, multiplicity of parts, or complicated adjustment techniques. Furthermore, it is a further object of this invention to provide a simple and effective tool facilitating assembly of the two elements comprising the thread end holder of this invention.

These objects of this invention are attained by provision of a thread end holder comprising an "O" ring of flexible material accommodated in stretched condition in an annular groove formed in an element supported on the sewing machine such as the presser foot securing thumb screw. The tool facilitating assembly of the "O" ring into the groove comprises an externally tapered sleeve along which the "O" ring may be gradually stretched as it is guided into the accommodating annular groove.

DESCRIPTION OF THE DRAWINGS

FIG. 1, is a side elevational view of the head end portion of a sewing machine having the thread end holder of this invention applied thereto, FIG. 2, is an enlarged cross sectional view taken substantially along line 2—2 of FIG. 1 and illustrating the position of parts and thread during initiation of bobbin thread replenishment, ishment, FIG. 3, is an enlarged cross sectional view of the presser retaining thumb screw taken substantially along line 3—3 of FIG. 1 and illustrating the details of construction of the thread end holder of this invention incorporated thereon, FIG. 4, is an elevational view of a tool for facilitating assembly of the thread end holder, and FIG. 5, is an elevational view of the tool and presser retaining thumbscrew illustrating the cooperative relation there between during use of the tool.

DESCRIPTION OF THE PREFERRED EMBODIMENT

Illustrated in FIG. 1 is the head end of a typical lockstitch sewing machine of the type to which a bobbin thread replenishing mechanism may be applied. In FIG. 1, 11 indicates the sewing head formed with a thread accommodating slot 12 into which a needle thread N from a supply spool (not shown) may be introduced to the sewing machine tension device and take-up mechanism in a path leading to a needle 13 secured on an endwise reciprocating needle bar 14 carried in the sewing head 11. The needle thread tension device and the take-up mechanism are not illustrated in FIG. 1 but may be of the type shown and described in detail in U.S. Pat. No. 4,422,395, Dec. 27, 1983, of D. Rodda, incorporated by reference herein.

The needle 13 is reciprocated endwise through a needle aperture 15 in a throat plate 16 carried on the sewing machine bed 17 and carries loops of the needle thread N into cooperative relation with a loop taker 18 within the bed 17. The needle 13 delivers thread N to the looptaker not only for concatenation by the looptaker into stitches during sewing operations, but also to be wound on a bobbin 19 in place in the looptaker 18 as a source of replenishment of locking or bobbin thread on the bobbin for use in the formation of lockstitches (Federal stitch types 301 or 701).

Also carried by the sewing head 11 is a presser bar 20 to which a presser foot 21 is secured by a retaining thumb screw 22 threaded into the presser bar.

FIG. 2, illustrates the looptaker, needle, and presser device at the initiation of a bobbin thread replenishing operation. Partial opening of a slide plate 23 on the sewing machine bed shifts a cam 24 on the slide plate against a plunger 25 in the bobbin 19 depressing the plunger 25 into engagement with a chuck 26 which inturn is frictionally engaged with the looptaker drive shaft 27 by a clutch spring 28. This bobbin replenishing arrangement is described in greater detail in the U.S. Pat. No. 4,515,099 which is incorporated herein as stated above.

The position of parts illustrated in FIG. 2 is one in which the needle thread N after having been engaged and transported part way around the bobbin 19 by the looptaker 18 has been drawn free of the looptaker beak (not shown) by the needle thread take-up mechanism and now must be engaged in a slot 30 in the upper flange of the bobbin 19 and then drawn in and wound against the bobbin hub by rotation of the bobbin. It will be noted that the supply limb Ns of needle thread which passes through the needle eye and is entrained through the slot 12 in the sewing head to the tension and take-up devices is also subject to the capstan effect of passage over and through many thread guides and other thread engaging surfaces each of which can contribute an increment to the total frictional resistance to movement of the supply limit Ns. It is this total frictional resistance which can exceed that which can be overcome by the clutch spring 28 during the bobbin so as to stall the bobbin drive and abort the thread replenishing operation.

In the present invention, as will now be described with reference to FIG. 3, of the accompanying drawings, a thread end holder for the free end of needle thread Nf, as indicated generally at 40, is provided on the presser foot retaining thumb screw 22. The thread end holder 40 is constructed in such a manner that dispite wide variation in tolerances of the parts, it can apply only a limited frictional resistance to movement of the free end of needle thread Nf less than that which can overcome the bobbin drive clutch spring 28.

As shown in FIG. 3, the presser foot retaining thumb screw 22 inwardly of a knurled head 41 has a cylindrical shoulder 42 into which can annular recess 43 is formed. The shoulder may be stepped for cooperation with the shank of the presser foot 21 and terminates in a thread portion 44 by which it engages the presser bar. The annular recess 43 is dimensioned slightly larger in diameter than that of the inside diameter of a standard commercially available flexible "O" ring 45.

So long as the annular recess 43 is dimensioned so as to slightly stretch an "O" ring 45 snapped therein, within a wide range of tolerance, the frictional force applied to a thread wrapped one half turn in the recess 43 beneath the "O" ring will be remarkably consistent and at a value well below that which can cause the bobbin driving clutch to disengage.

While the present thread end holder need not necessarily be applied to the presser retaining thumb screw, this preferred arrangement further enhances the utter simplicity and cost effectiveness of the present invention.

FIG. 4, illustrates a tool 50 for facilitating assembly of the "O" ring 45 into the annular groove 43 in the thumb screw 22. The tool 50 comprises a frusto-conical member preferrably with a polished exterior. The large extremity of the tool 50 is preferrably the same diameter as the shoulder 42 of the presser foot securing thumb screw 22 and is formed with a recess 51 accommodating the stepped portion of the thumb screw shoulder 42 as well as the threaded portion 44. The small extremity of the tool is preferrably smaller in diameter than the internal diameter of the "O" ring 45. As shown in FIG. 5, when placed against a thumb screw 22, the tool provides a smooth ramp along which an "O" ring may be easily forced over the thumb screw shoulder 42 and into the annular recess 43.

Having set forth the nature of this invention, what is claimed herein is:

1. A needle thread end holder for a sewing machine having a presser foot supporting presser bar, a presser foot securing thumb screw carried by said presser bar, said presser foot securing thumb screw formed with an annular groove, and a flexible "O" ring accommodated in stretched condition in said annular groove and adapted to apply a limited frictional resistance to a thread introduced into said annular groove beneath said "O" ring.

2. A needle thread end holder as set forth in claim 1 in which said presser foot securing thumb screw is formed at one extremity with a knurled head, and at the other extremity with a threaded portion for engagement with the sewing machine presser bar, and a cylindrical shoulder on said thumb screw between said knurled head and said thread portion in which shoulder said annular "O" ring accommodating groove is formed.

3. A needle thread end holder as set forth in claim 2 in combination with a tool facilitating insertion of said flexible "O" ring in stretched condition in said annular groove, said tool comprising a frusto-conical member having a large extremity of substantially the same diameter as said thumb screw shoulder in which said annular groove is formed, a recess in said large extremity of said tool, said recess accommodating said thumb screw threaded portion, and a small extremity of said frusto-conical tool smaller in diameter than the internal diameter of said flexible "O" ring.

4. A needle thread end holder for a sewing machine having a bobbin thread replenishing mechanism with a bobbin rotating drive including a friction clutch device, a needle thread end holder for gripping the needle thread end during initiation of bobbin thread replenishment, said thread end holder comprising a presser foot securing thumb screw supported on said sewing machine and formed with an annular groove, a flexible "O" ring accommodated in stretched condition in said annular groove to apply frictional resistance to a needle thread end introduced into said annular groove beneath said "O" ring less than that necessary to overcome said friction clutch device in said bobbin rotating drive.

* * * * *